US012150604B2

(12) United States Patent
Stikes, III

(10) Patent No.: US 12,150,604 B2
(45) Date of Patent: Nov. 26, 2024

(54) TOILET LID AND URINAL ASSEMBLY

(71) Applicant: John Gwinn Stikes, III, Ball Ground, GA (US)

(72) Inventor: John Gwinn Stikes, III, Ball Ground, GA (US)

( * ) Notice: Subject to any disclaimer, the term of this patent is extended or adjusted under 35 U.S.C. 154(b) by 0 days.

(21) Appl. No.: 18/107,350

(22) Filed: Feb. 8, 2023

(65) Prior Publication Data

US 2023/0218128 A1 Jul. 13, 2023

Related U.S. Application Data

(63) Continuation of application No. 17/072,931, filed on Oct. 16, 2020, now Pat. No. 11,607,090.

(60) Provisional application No. 62/923,746, filed on Oct. 21, 2019.

(51) Int. Cl.
*A47K 13/08* (2006.01)
*A47K 13/10* (2006.01)

(52) U.S. Cl.
CPC ..... *A47K 13/08* (2013.01); *A47K 13/105* (2013.01)

(58) Field of Classification Search
CPC ..... A47K 13/08; A47K 13/14; A47K 13/24; A47K 13/28; A47K 13/10; A47K 11/02; E03D 13/00; E03D 13/002; E03D 13/005; E03D 13/025
See application file for complete search history.

(56) References Cited

U.S. PATENT DOCUMENTS 1,975,570 A * 10/1934 Charlie ..... A47K 13/12 D23/311
D237,185 S * 10/1975 O'Neil ..... D23/311
(Continued)

FOREIGN PATENT DOCUMENTS

DE 19514589 C1 * 8/1996 ..... A47K 13/08
DE 29820437 U1 * 10/1999 ..... A47K 13/08
(Continued)

*Primary Examiner* — Erin Deery
(74) *Attorney, Agent, or Firm* — GRONHOLM PATENT SERVICES

(57) ABSTRACT

An improved toiled system including a urine receptacle with a guide channel is provided, said guide channel having an inlet port that is configured to be positioned closer to the user's point of urination, such that the user may urinate into the inlet port with a greater degree of comfort that a higher percentage of said user's urine will be contained into the urine receptacle. The guide channel is configured to be moved from a retracted to an extended position, said extended position being to allow for use by the user, and said retracted position being to allow for storage of the guide channel out of the way when not being used. In one configuration a toilet with a seat may be used in its conventional manner when said guide channel is in said retracted position. Another significant feature is the use of a return feature, which causes the lid to be in the up position, and the seat in the down position, after use by the user, for the convenience of the next user. When this feature is used with the above retraction/extension position, it solves the issue of a woman wanting the toilet seat down with very little effort to the man because it automatically returns everything to the seated position for a woman simply by the man releasing the handles or foot pedal.

2 Claims, 17 Drawing Sheets

(56) References Cited

U.S. PATENT DOCUMENTS

| | | | | | |
|---|---|---|---|---|---|
| 4,549,321 | A * | 10/1985 | Douillard | E03D 13/00 | 4/312 |
| 5,276,925 | A * | 1/1994 | Blaha | E03D 11/025 | 4/300.3 |
| 5,299,328 | A * | 4/1994 | Walega | E03D 1/003 | 4/341 |
| D384,139 | S * | 9/1997 | Tribolet | D23/311 | |
| 8,032,955 | B1 * | 10/2011 | Emerson | A47K 13/24 | 4/341 |

FOREIGN PATENT DOCUMENTS

| | | | | |
|---|---|---|---|---|
| DE | 102015104930 | A1 * | 10/2016 | A47K 13/00 |
| KR | 20170046870 | A * | 5/2017 | |

* cited by examiner

Showing different lid positions

Fig. 5 Inlet Funnel being Pivoted into Position

Foot Pedal Providing Pivot Action

Various passageway locations
(examples only)

Assembly of lid subassembly 130 - Steps 1-6

Attachment of lid subassembly 130 to seat 126 - Part One

Step A

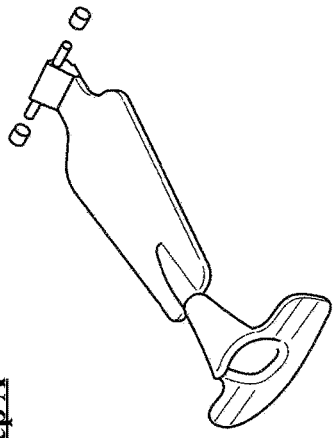

Slide the left and right springs onto the axle of the *lid sub-assembly* 130

Step B

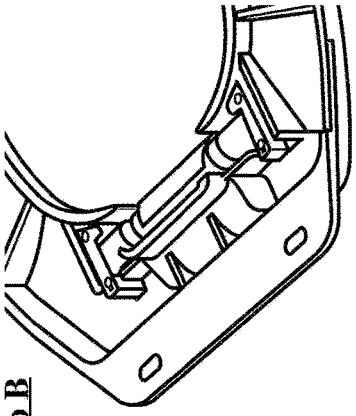

Apply grease to the bearing surfaces in the *seat*.

Step C

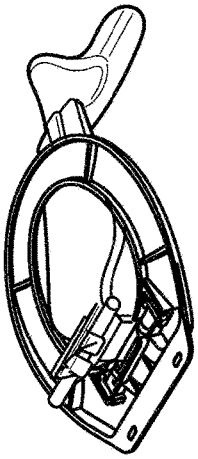

Place the *lid sub-assembly* into the seat. Align springs in the seat.

Step D

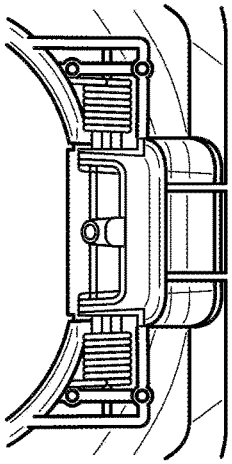

Ensure that the springs are within their alignment ribs before proceeding to the next step.

Step E

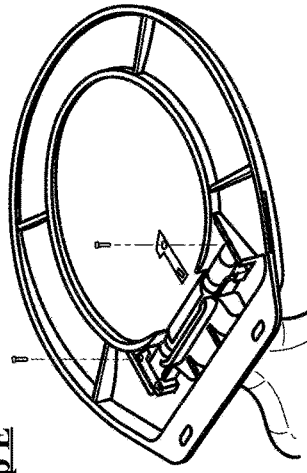

Apply grease to top of axle and install both *lid retaining brackets* with one pan-head screw each in the hole closest to the seat's opening. Firmly tighten screws.

*Ensure that the springs are still within their alignment ribs.

Step F

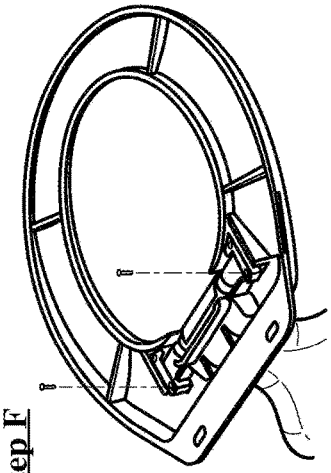

Install a pan-head screw in the remaining holes on the *lid retaining brackets* so that the screw begins to compress the bracket. *Do not fully tighten.*

Fig. 15

TOILET LID AND URINAL ASSEMBLY

CROSS REFERENCE TO RELATED APPLICATION

This application claims the benefit and priority of U.S. provisional application No. 62/923,746, filed Oct. 21, 2019, and nonprov application Ser. No. 17/072,931 filed 16 Oct. 2020, both entitled "METHOD AND APPARATUS FOR PROVIDING AN IMPROVED TOILET and incorporates both by reference.

FIELD

This disclosure relates to an improved method and apparatus for providing an improved toilet.

BACKGROUND

The dispensing of urine into receptacles has been known for centuries, with such receptacle being configured to contain and divert such urine into remote locations such as sewers or the like.

One need in the art is to provide a means for such urine to be dispensed by a human into such receptacles without urine splatter in and around the toilet bowl and floor. Such can be an inconvenience as well as a health hazard.

Another need in the art is the issue of positioning the toilet seat and lid after use.

Thus, there is a need in the art for improved urine receptacles.

SUMMARY

The present invention relates generally to urine receptacles, and more particularly to toilets having a seat or other portion which may be used by different sexes, and/or prone to urine splatter.

A urine receptacle with a guide channel is provided, said guide channel having an inlet port that is configured to be positioned closer to the user's point of urination, such that the user may urinate into the inlet port with a greater degree of comfort that a higher percentage of said user's urine will be contained into the urine receptacle. The guide channel is configured to be moved from a retracted to an extended position, said extended position being to allow for use by the user, and said retracted position being to allow for storage of the guide channel out of the way when not being used. In one configuration a toilet with a seat may be used in its conventional manner when said guide channel is in said retracted position.

Another significant feature is the use of a return feature, which causes the lid to be in the up position, and the seat in the down position, after use by the user, for the convenience of the next user. When this feature is used with the above retraction/extension position, it solves the issue of a woman wanting the toilet seat down with very little effort to the man because it automatically returns everything to the seated position for a woman simply by the man releasing the handles or foot pedal.

In accordance with another aspect of the present invention is provided a device for use with a toilet, said toilet including a toilet bowl for receiving solid waste and urine from a human, said bowl configured to accept urine from a urine stream passing along a urine path into the bowl, said stream originating from said human while standing at a position facing the bowl, said device comprising: A) A movable urine receptacle having an inlet and an outlet, said receptacle being movable from a first position wherein said receptable inlet is spaced apart from said urine stream, to a second position wherein said receptable inlet intercepts said urine stream at a portion above said toilet bowl so as to reduce splatter thereon, such that said receptacle diverts at least a portion of said urine stream into said receptacle inlet such that said portion moves from said inlet to said outlet; and B) a passageway connected to said outlet of said urine receptacle and configured to accept said portion of said urine stream from said receptacle and direct said portion of said urine stream into said toilet bowl.

In accordance with another aspect of the present invention is provided a device for use with a toilet as set forth above, wherein said receptacle inlet is part of a seat assembly.

In accordance with another aspect of the present invention is provided a device for use with a toilet as set forth above, wherein said receptacle inlet and said passageway are part of a seat assembly.

In accordance with another aspect of the present invention is provided a device for use with a toilet as set forth above, wherein said receptacle inlet is part of a lid assembly.

In accordance with another aspect of the present invention is provided a device for use with a toilet as set forth above, wherein said receptacle inlet and said passageway are part of a lid assembly.

In accordance with another aspect of the present invention is provided a device for use with a toilet as set forth above, wherein said first position is a retracted position, and said second position is and extended position.

In accordance with another aspect of the present invention is provided a device for use with a toilet as set forth above, further comprising handles for manipulation of said lid assembly between said positions.

In accordance with another aspect of the present invention is provided a device for use with a toilet as set forth above, further comprising a sensor for providing a signal to urge said receptacle to said first position.

In accordance with another aspect of the present invention is provided a device for use with a toilet as set forth above, further comprising a sensor for flushing said toilet based upon a change of position of said device.

In accordance with another aspect of the present invention is provided a device for use with a toilet as set forth above, further comprising a biasing device for urging said receptacle to said first position.

In accordance with another aspect of the present invention is provided a device for use with a toilet as set forth above, wherein said biasing device is a spring for urging said receptacle to said first position.

In accordance with another aspect of the present invention is provided a device for use with a toilet as set forth above, further comprising a foot operated member configured to move said receptacle to said second position when activated.

In accordance with another aspect of the present invention is provided a device for use with a toilet as set forth above, wherein said device is configured to be mounted to a conventional toilet bowl including two holes proximate the rear of the bowl, said holes having coparallel bore axes which are substantially vertical when said toilet is conventionally installed.

In accordance with another aspect of the present invention is provided a device for use with a toilet, said toilet including a toilet bowl for receiving solid waste and urine from a human, said bowl configured to accept urine from a urine stream passing along a urine path into the bowl, said stream originating from said human while standing at a position facing the bowl, said device comprising: A) a seat for allowing a user to sit at a sitting position such that solid human waste may be transferred into said bowl while said human is sitting on said seat; B) a movable urine receptacle having an inlet and an outlet, said receptacle being movable from a first position wherein said receptable inlet is spaced apart from said urine stream, to a second position wherein said receptable inlet intercepts said urine stream at a portion above said toilet bowl so as to reduce splatter thereon, such that said receptacle diverts at least a portion of said urine stream into said receptacle inlet such that said portion moves from said inlet to said outlet; C) a passageway connected to said outlet of said urine receptacle and configured to accept said portion of said urine stream from said receptacle and direct said portion of said urine stream into said toilet bowl.

In accordance with another aspect of the present invention is provided a device as described above, wherein said seat is a seat assembly, and receptacle inlet and said passageway are each at least partially defined by said seat assembly.

In accordance with another aspect of the present invention is provided a device as described above, wherein said receptacle inlet and said passageway are each at least partially defined by a lid assembly.

In accordance with another aspect of the present invention is provided a device as described above, further comprising a seat being pivotable from a sitting position, allowing said user to sit at said sitting position, to a raised position, which would not allow said user to sit.

In accordance with another aspect of the present invention is provided a device as described above, further comprising one or more springs to urge said receptacle to said first position, and to urge said seat toward said sitting position.

In accordance with another aspect of the present invention is provided a device as described above, further comprising one or more springs to urge said receptacle to said first position.

In accordance with another aspect of the present invention is provided a device as described above, wherein said lid assembly can also be moved to a third position in which it at least partially covers said bowl.

In accordance with another aspect of the present invention is provided a device as described above, further comprising a sensor for providing a signal to urge said receptacle to a desired position, said sensor configured to recognize motion at a position near said device such as when said device is being used during standing urination, but to distinguish such motion from motion detected when a person is seated.

In accordance with another aspect of the present invention is provided a device for use with a toilet, said toilet including a toilet bowl for receiving solid waste and urine from a human, said bowl configured to accept urine from a urine stream passing along a urine path into the bowl, said stream originating from said human while standing at a position facing the bowl, said device comprising: A) a seat for allowing a user to sit at a sitting position such that solid human waste may be transferred into said bowl while said human is sitting on said seat, said seat being pivotably mounted relative to said bowl so as to be pivotable from a sitting position, allowing said user to sit at said sitting position, to a raised position, which would not allow said user to sit; B) a movable lid assembly, said lid assembly itself including: 1) a urine receptacle having an inlet and an outlet; and 2) a passageway connected to said outlet of said urine receptacle, said movable lid assembly being configured to be moved from a first position wherein said receptable inlet is spaced apart from said urine stream, to a second position wherein said receptable inlet intercepts said urine stream at a portion above said toilet bowl so as to reduce splatter thereon, and said receptacle diverts at least a portion of said urine stream into said receptacle inlet such that said portion moves from said inlet to said outlet and then through said passageway and finally into said toilet bowl, wherein said seat assembly is pivotably attached to said bowl, and wherein said movable lid assembly is pivotably mounted relative to said seat, such that said movable lid assembly can be moved between said first and second positions while said seat is in said sitting position.

In accordance with another aspect of the present invention is provided a device as described above, wherein said lid assembly can also be moved to a third position when said seat is in said sitting position, in which said lid assembly at least partially covers said bowl.

In accordance with another aspect of the present invention is provided a device as described above, further comprising one or more springs to urge said receptacle to said first position, and to urge said seat toward said sitting position.

In accordance with another aspect of the present invention is provided a device as described above, wherein said seat is configured to be mounted to a conventional toilet bowl including two holes proximate the rear of the bowl, said holes having coparallel bore axes which are substantially vertical when said toilet is conventionally installed.

In accordance with another aspect of the present invention is provided a device for use with a toilet having a lid and a seat, said lid and said seat each being pivotably attached relative to said bowl; said device comprising a torsion spring configured for returning one of said lid and seat to a desired position when not in use.

In accordance with another aspect of the present invention is provided a device as described above, wherein said torsion spring is configured to return said lid to a desired position when not in use.

In accordance with another aspect of the present invention is provided a device as described above, wherein said torsion spring is configured to return said seat to a desired position when not in use.

These and other aspects will become readily apparent upon further review of the following specification and drawings. Other objects, features, and advantages of the present invention will become apparent upon reading the following detailed description of the preferred embodiment of the invention when taken in conjunction with the drawing and the appended claims.

BRIEF DESCRIPTION OF THE DRAWINGS

FIG. 15 shows Part One of the assembly of lid subassembly 130 (aka passageway assembly 130) to seat 126.

DETAILED DESCRIPTION

Introduction

The present invention now will be described more fully hereinafter with reference to the accompanying drawings, in which some, but not all embodiments of the inventions are shown. This invention may be embodied in many different forms and should not be construed as limited to the embodiments set forth herein; rather, these embodiments are provided so that this disclosure will satisfy applicable legal requirements. Like numbers refer to like elements throughout.

Reference is now made to the figures, in which like elements indicate like elements throughout the several views.

Element List

Here is a list of the various elements:

- 10 Overall System Including Toilet
  - 20 Toilet
    - 22 Base
    - 24 Bowl
    - 26 Seat
    - 27 Lid
    - 28 Torsion Spring
  - 30 Passageway assembly
    - 32 Body of passageway
    - 34 Inlet funnel
      - 34S Inlet funnel guide surface
    - 36 Exit Port
    - 38 Handles
    - 39 Foot pedal
  - 130 Passageway assembly
    - 132 Passageway Body
      - 132-UP passageway body upper portion
      - 132-LP passageway body lower portion
      - 132-IT passageway body inner tubing
    - 134 Inlet funnel
    - 136 Exit Port
    - 138 Handles
  - 226 Seat
  - 230 Passageway assembly

Discussion

General Construction and Operation

Figure 1:
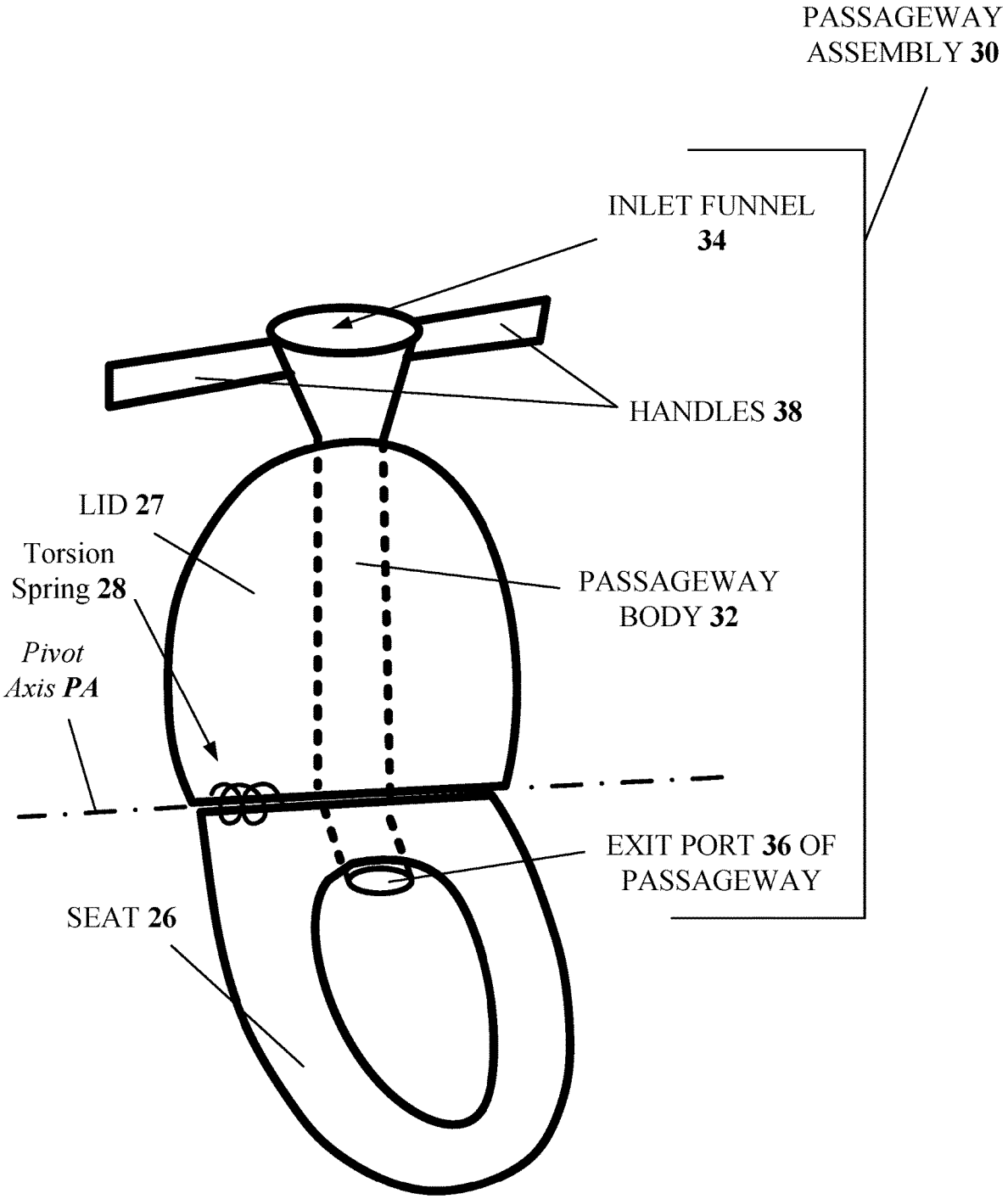
FIG. 1 shows the passageway assembly 30 of the present invention as used with conventional parts of a toilet, namely a toilet seat lid 27 and a toilet seat 26. In this drawing, the passageway assembly 30 includes an inlet funnel 34, handles 38, the passageway body 32, and a passageway exit port 36. A torsion spring 28 is also shown. The toilet seat lid 27 and the toilet seat 26 are pivotably mounted relative to the toilet about a pivot axis PA. The seat is pivotably mounted relative to said bowl so as to be pivotable from a sitting position, allowing said user to sit at said sitting position, to a raised position, which would not allow said user to sit. Torsion Spring 28 is used to automatically position Lid 27 in up position as shown, and seat 26 in down position as shown, for use by next user.
Figure 2:
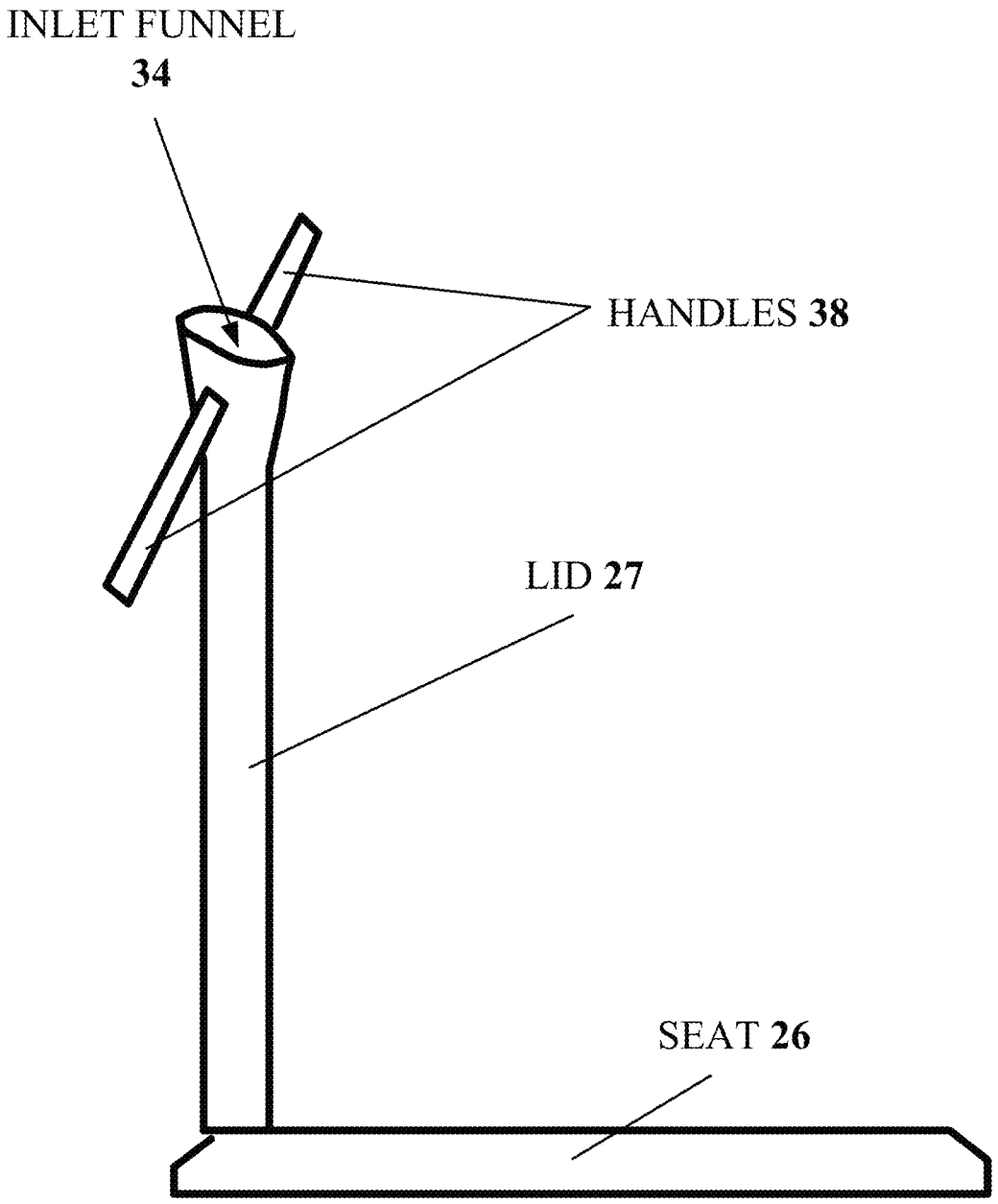
FIG. 2 shows another view of a version of the invention, showing an inlet funnel 34, handles 38, and a lid 27.

Reference is first made to FIG. 1, which shows the basic concept of the provision of a passageway assembly 30 used for the disposal of urine, with the passageway assembly 30 having an inlet funnel configured to accept urine from the user, such that said urine may be diverted to a remote location. The inlet funnel 34 may be manipulated from its "stored/retracted" position, as shown in FIG. 1, to an "engaged/extended" position as shown elsewhere, such that urine flowing into the inlet funnel 34 may travel through the passageway body 32 down through the lid 27 (or atop or below it as shown later), such that it then exits the passageway assembly 30 via an exit port 36 configured to dispense urine into the back of the bowl of the toilet.

As will be shown later, other variations on this configuration are likewise contemplated, including but not limited to the passage being on the back/top/inside of the lid and/or seat of the toilet so that the entry of passage can be brought to the individual releasing the urine. This would reduce or eliminate the amount of urine unable to make it into the toilet. The chamber of passage may be brought from use, to the original position using a spring located at the rod of the toilet seat assembly.

Another important concept is a return feature which causes the lid to be automatically moved to the up position, and the seat in the down position, after use by the user, for the convenience of the next user. When this feature is used with the above retraction/extension position, it solves the issue of a woman wanting the toilet seat down with very little effort to the man because it automatically returns everything to the seated position for a woman simply by the man releasing the handles or foot pedal.

Detailed Construction

A more detailed explanation of the construction of the present invention is now provided.

Figure 4:
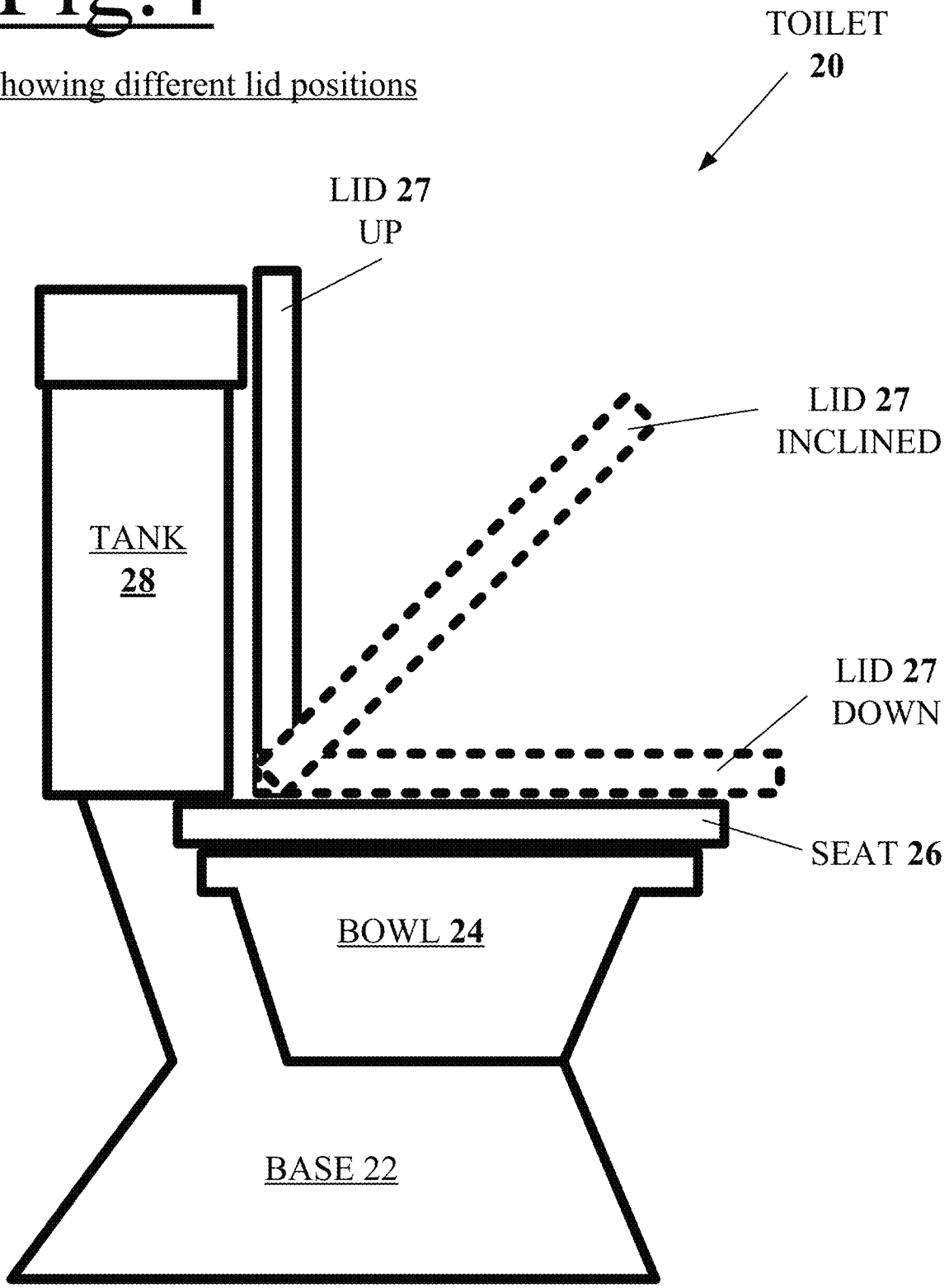
FIG. 4 shows a conventional toilet 20, with a base 22, a bowl 24, a seat 26, a lid 27, and a tank 28. The lid 27 is shown in three positions; up, inclined, and down.

Reference is now made to FIG. 4, which shows a conventional toilet 20, with a base 22, a bowl 24, a seat 26, a lid 27, and a tank 28. The lid 27 is shown in three positions; up (shown in solid line), inclined (shown in dotted line), and down (also shown in dotted line). This drawing is included to show the various seat positions.

Figure 5:
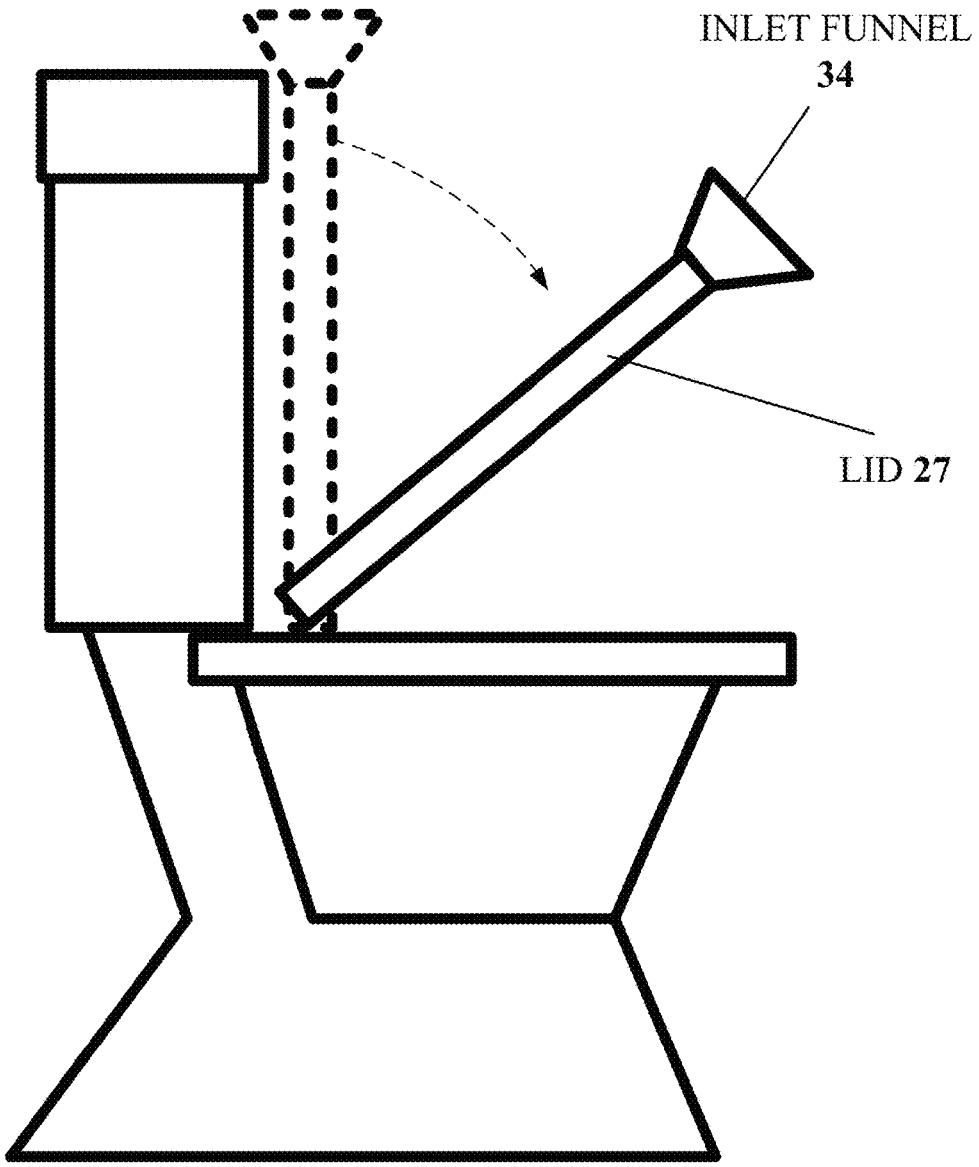
FIG. 5 is a drawing similar to that shown in FIG. 5, except that an inlet funnel 34 is shown attached to the lid 27 of the toilet, with the funnel/lid combination 34/27 being shown in dotted line in its retracted position, and in solid line in its "engaged" position. It is at this engaged position at which a user may conveniently dispense urine from their body into the funnel 34.

FIG. 5 is a drawing similar to that shown in FIG. 5, except that an inlet funnel 34 is shown attached to the lid 27 of the toilet, with the funnel/lid combination 34/27 being shown in dotted line in its retracted position, and in solid line in its "engaged" position. It is at this engaged position at which a user may conveniently dispense urine from their body into the funnel 34.

Figure 6:
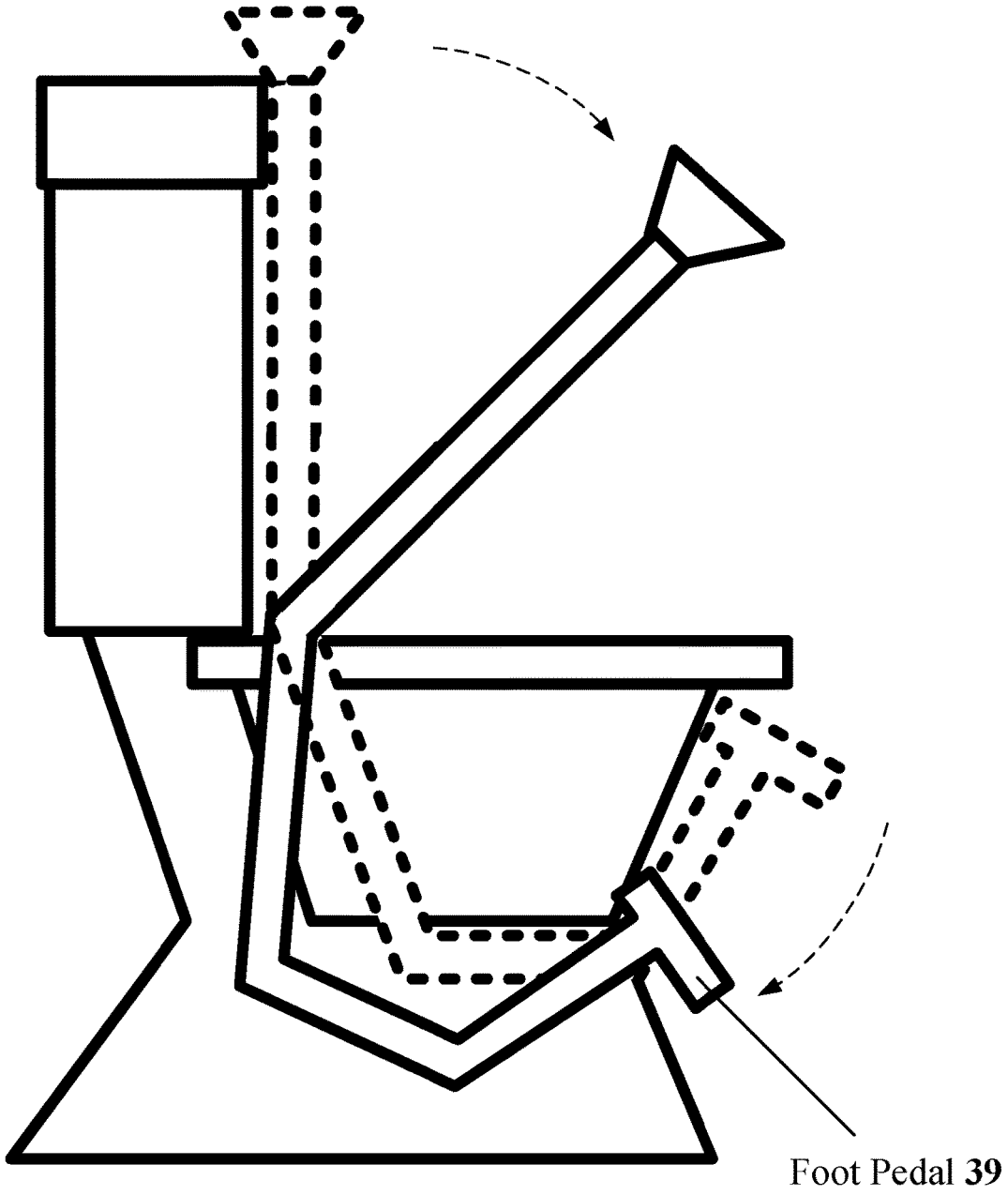
FIG. 6 shows the action of a foot pedal 39, which can be used to move the lid (with the inlet funnel attached) between the two positions shown in FIG. 5. Note that a torsion spring (not shown here but shown as 28 in FIG. 1) may be used to return the foot pedal to its home position as needed.

FIG. 6 shows the action of a foot pedal 39, which can be used to move the lid (with the inlet funnel attached) between the two positions shown in FIG. 5 about pivot axis PA (which in FIG. 6 is parallel to the viewers line of sight). Note that a torsion spring (not shown in this view) may be used to return the foot pedal to its home position as needed. This torsion spring may be configured to simply return the lid to its retracted position, or it may also be used to both return the lid to its retracted position and to return the seat to the down position. Any other suitable spring or return means (including simple gravity) could also be used.

Figure 7:
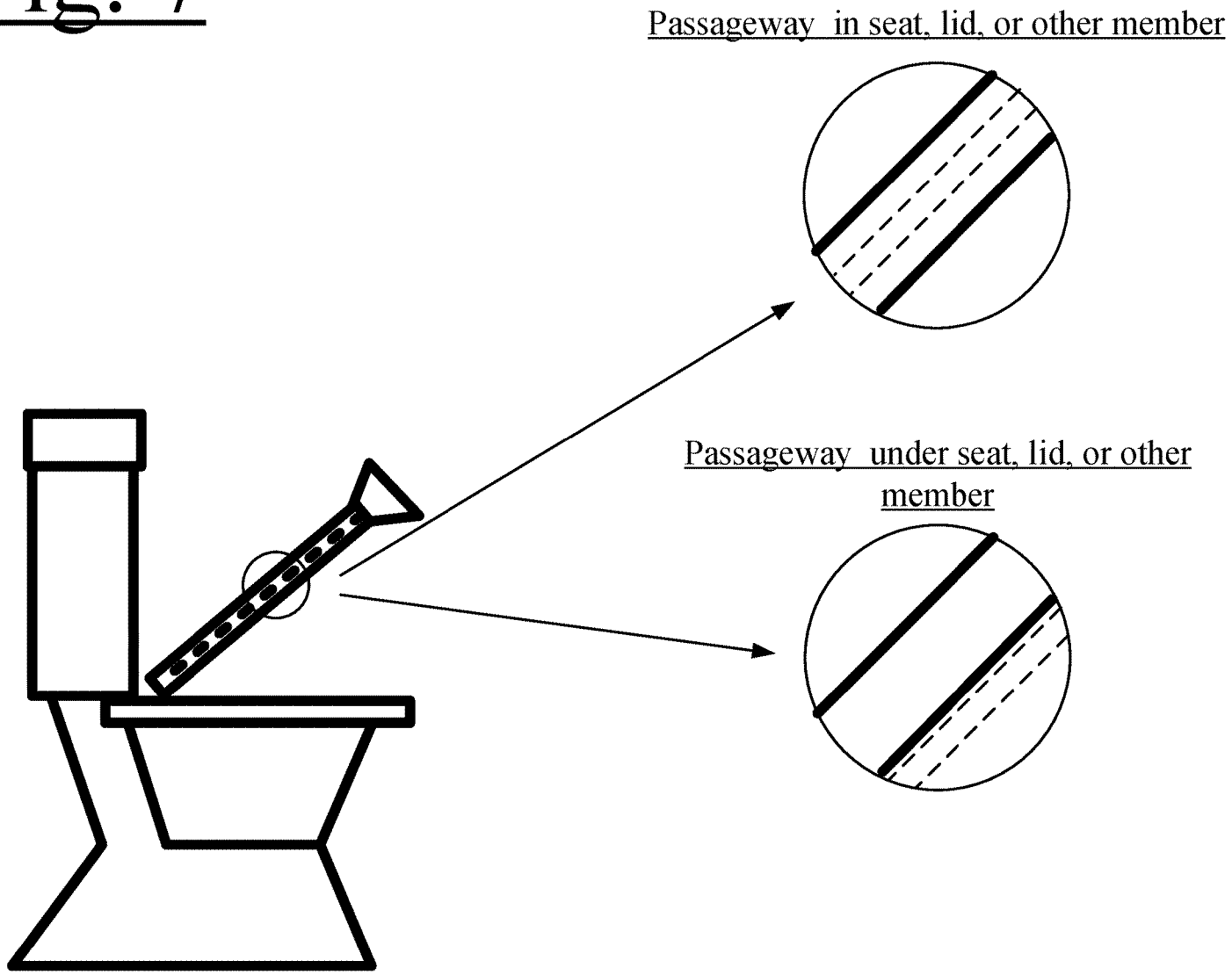
FIG. 7 shows ways that the passageway body may be positioned within the seat; with the passage in the seat, and the passage under the seat. Also note that passageway could be at other positions, including but not limited to one the side or atop the seat. The passageway also could be in the lid or another member.
Figure 8:
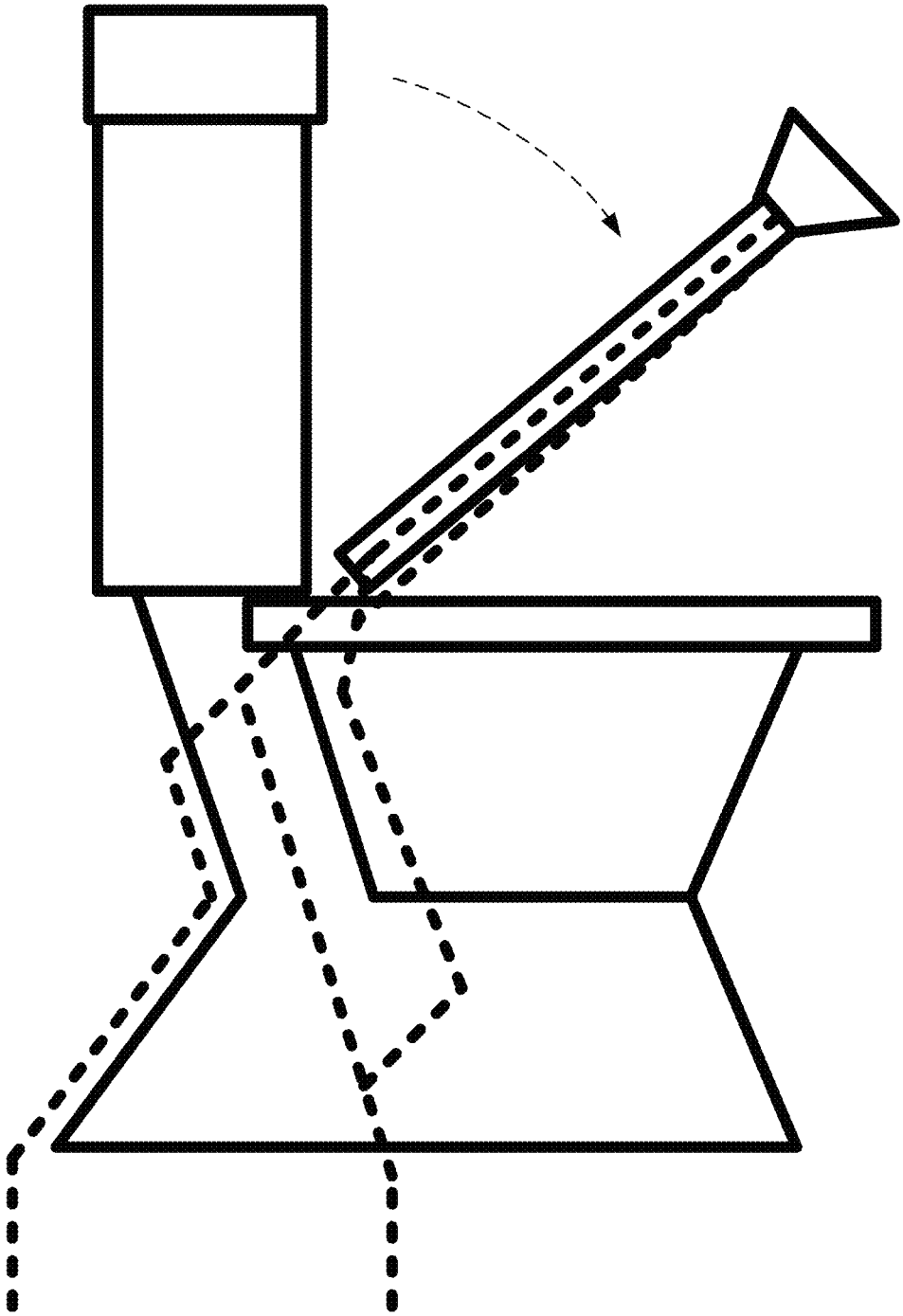
FIG. 8 shows various passageways which the passageway assembly may direct the urine flow.

FIG. 7 shows ways that the passageway body may be positioned within the seat; with the passage in the seat, and the passage under the seat. Also note that passageway could be at other positions, including but not limited to one the side or atop the seat.

It should be understood that in this FIG. 5 and FIG. 6 configuration, urine passes into the funnel 34, then into the passageway body 32 (which is incorporated inside the lid as shown in the top option in FIG. 7.

Figure 3:
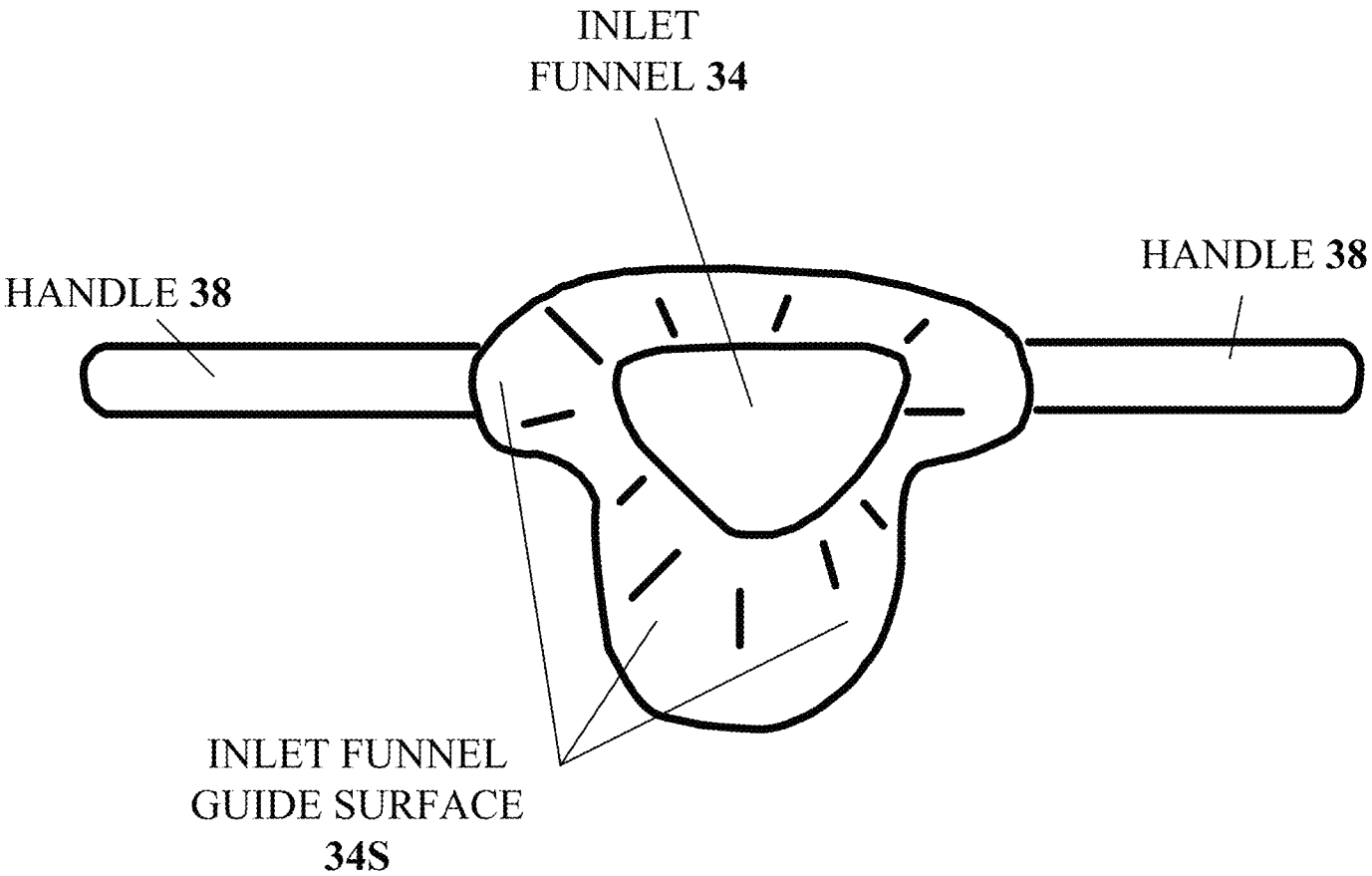
FIG. 3 shows more detail on the inlet funnel 34, which as may be seen can include a guide surface 34S around its periphery. Also shown are the handles 38.

FIG. 3 shows more detail on the inlet funnel 34, which as may be seen can include a guide surface 34S around its periphery. Also shown are the handles 38, which can be used to pull the inlet funnel into its engaged position and to push it back into its retracted position. If the lid holding the inlet funnel is spring loaded, the handles placed at can be used to hold the urine chamber during use, and when released the spring will return the inlet funnel 34 to the proper position.

Detailed Operation of Versions Shown in FIGS. 1-8

In the configuration shown in FIG. 1, a user would walk up to the toilet and manipulate the handles 38 manually such that the lid 27 and inlet funnel 34 move from the position from the position shown in FIG. 1 to the position shown in FIG. 5 (although no handles are shown in FIG. 5). At that point the user would urinate into the inlet funnel 34 while in its "closer in" position. Urine would then pass into the inlet funnel 34, through the passageway body 32, and out of the exit port 36 and into the bowl 24 of the toilet 20. The user would then subsequently manipulate the handles 38 manually such that the lid 27 and inlet funnel 34 move from the position from the position shown in FIG. 5 to the position shown in FIG. 1. Operation is then complete for the configuration with handles only.

In the configuration shown in FIG. 6 (including a foot pedal 39), a user would walk up to the toilet and step on the foot pedal 39 such that the lid 27 and inlet funnel 34 move from the position shown in dotted line in FIG. 6 to the position shown in solid line in FIG. 6. (although no handles are shown in FIG. 5). Urine would then pass into the inlet funnel 34, through the passageway body 32, and out of the exit port 36 and into the bowl 24 of the toilet 20. The user would then subsequently release the foot pedal 39 such that the lid 27 and inlet funnel 34 move from the position shown in FIG. 5 to the position shown in FIG. 1. Operation is then complete for the configuration with a foot pedal only. The foot pedal provides an advantage, especially in a public environment, in that the user doesn't have to touch anything.

Note that handles and the foot pedal could both be provided and used together in another embodiment. In this configuration, if the lid holding the inlet funnel is spring loaded, the handles can be used to hold the urine chamber and when released the spring will return the toilet seat assembly to the proper position.

As noted above, the torsion spring may be configured to simply return the lid to its retracted position, or it may also be used to both return the lid to its retracted position and to return the seat to the down position. Said another way, torsion spring 28 can keep the seat down and the lid up; the one moves the lid or seat, they will return to a seat down and lid up position. This can be done by one end of the torsion spring pushing the lid up and the other end of the spring one pushing the seat down.

This solves the issue of where the toilet seat should be using a spring to return it to the proper position.

A pivot axis PA is also shown, about which the lid and seat pivot.

It may be understood that this return feature is significant when used with the above retraction/extension configuration noted above, solves the issue of a woman wanting the toilet seat down with very little effort to the man because it automatically returns everything to the seated position for a woman simply by the man releasing the handles or foot pedal.

It should be understood that a conventional toilet could be retrofitted with the device of the present invention, by replacing a conventional toilet seat/lid combination with a modified toilet seat/lid combination with the inlet funnel in the lid or the seat. Such a conventional configuration would include a toilet bowl including two holes proximate the rear of the bowl, said holes having coparallel bore axes which are substantially vertical when said toilet is conventionally installed.

Another retrofit involves replacing a conventional toilet seat/lid combination with a modified toilet third member/seat/lid combination with the inlet funnel in the lid of the "back" or third attachment described elsewhere.

More Ornamentally Refined Version Shown in FIGS. 9-16

FIGS. 9-16 show a more "ornamentally refined" version of the current concept(s). One feature shown in these figures is the use of a passageway assembly 130 (aka lid assembly 130), which is similar in function to the passageway assembly 30 shown in previous figures, but is also configured to be assembled from multiple elements, Reference is now made to FIG. 9, which is a pictorial view showing a more "refined" version of the concept as compared to FIG. 1. Shown is a passageway assembly 130, which includes a passageway body 132, an inlet funnel 134, an exit port 136 of the passageway, and handles 138. Also shown is a Pivot Axis PA, and a seat 126. The passageway assembly 130 may also be known as a lid assembly 130.

Figure 9:
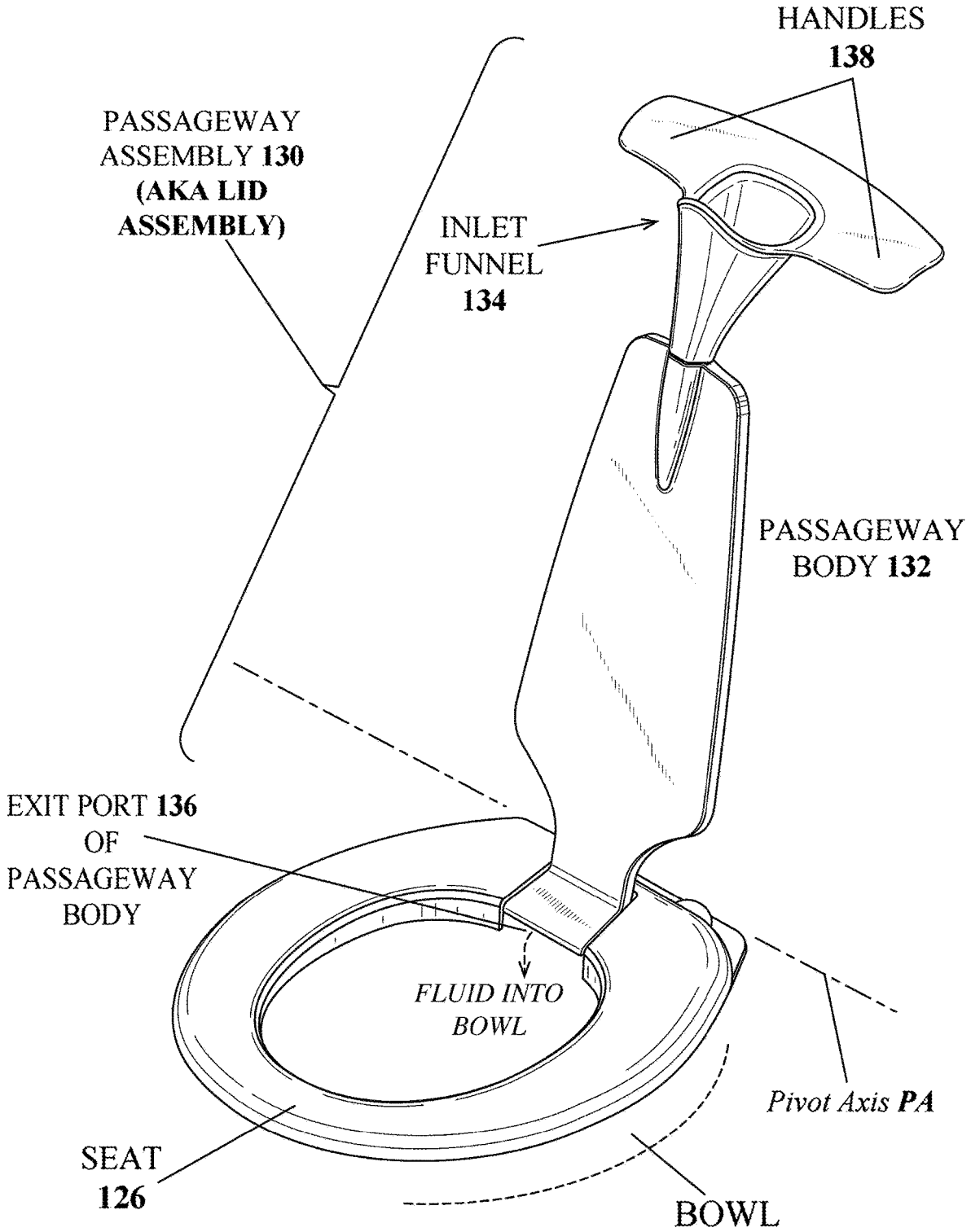
FIG. 9 is a pictorial view showing a more "refined" version of the concept as compared to FIG. 1. Shown is a passageway assembly 130, which includes a passageway body 132, an inlet funnel 134, an exit port 136 of the passageway, and handles 138. Also shown is a Pivot Axis PA, and a seat 126. The passageway assembly 130 may also be known as a lid assembly 130.
Figure 10:
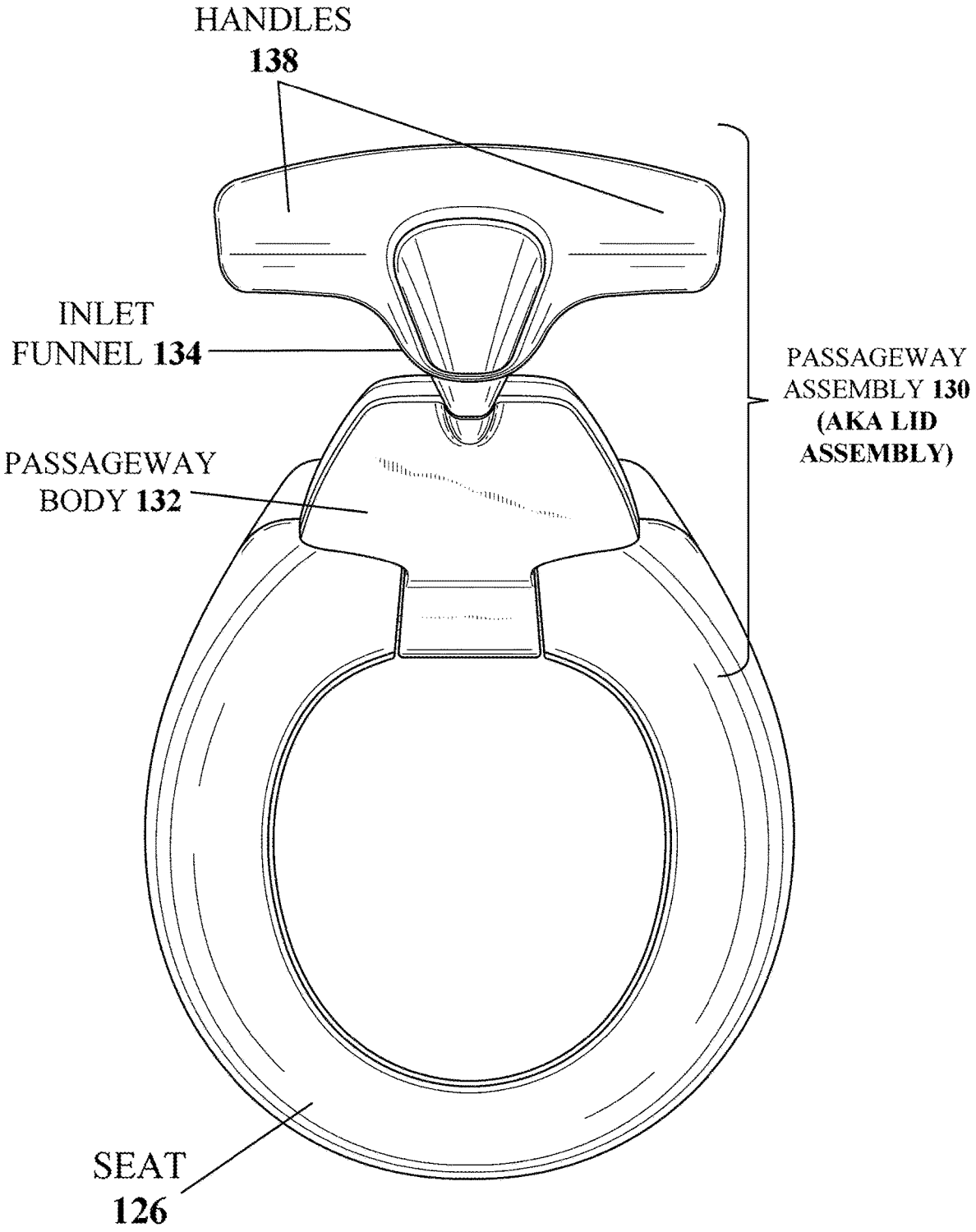
FIG. 10 is a top plan view of that shown in FIG. 9.

FIG. 10 is a top plan view of that shown in FIG. 9.

Figure 11:
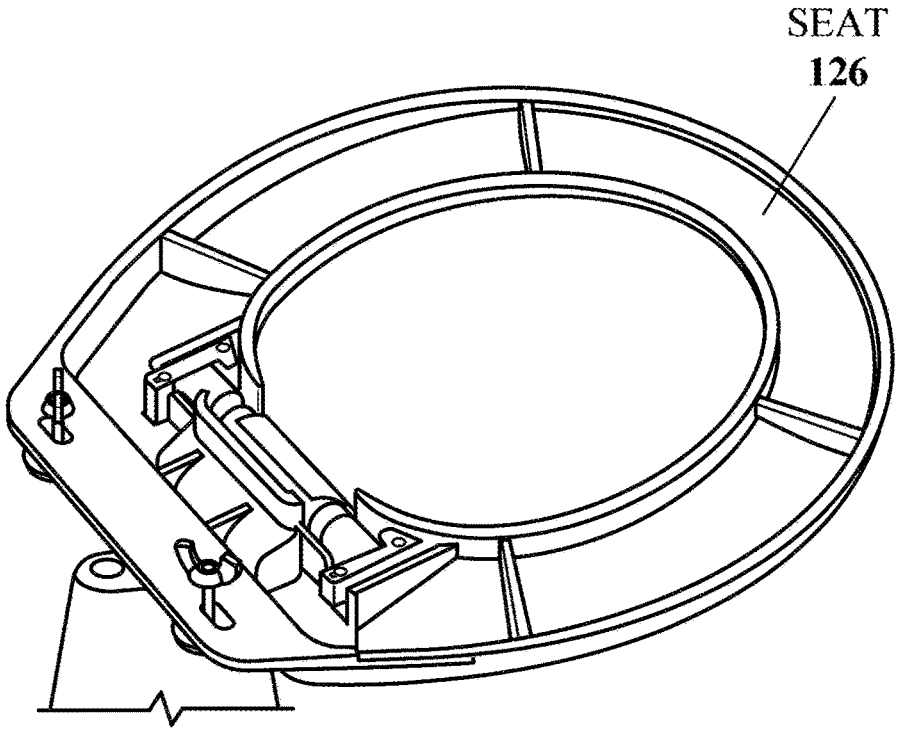
FIG. 11 is an underside view of the seat 126.

FIG. 11 is an underside view of the seat 126.

Figure 12:
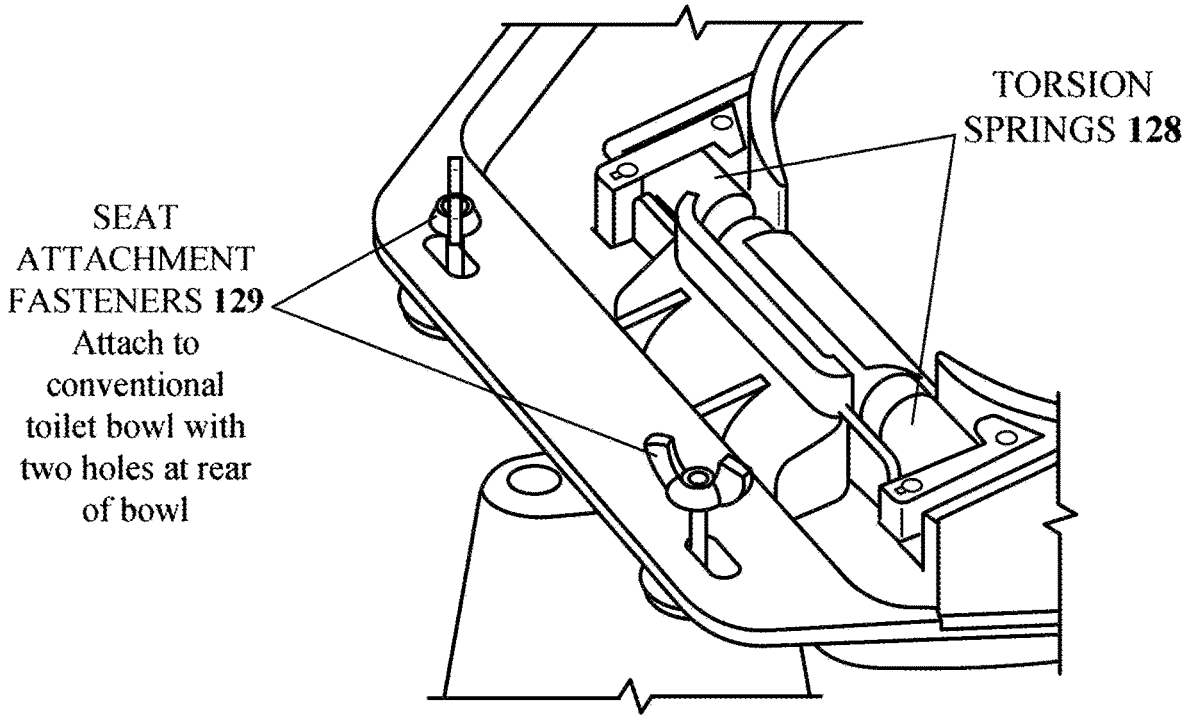
FIG. 12 is more detailed view of that shown in FIG. 11, including torsion springs 128 and seat attachment fasteners 129.

FIG. 12 is more detailed view of that shown in FIG. 11, including torsion springs 128 and seat attachment fasteners 129. It may be understood that these fasteners enable the seat to be pivotably attached to a conventional toilet including two holes proximate the rear of the bowl, said holes having coparallel bore axes which are substantially vertical when said toilet is conventionally installed.

Figure 13:
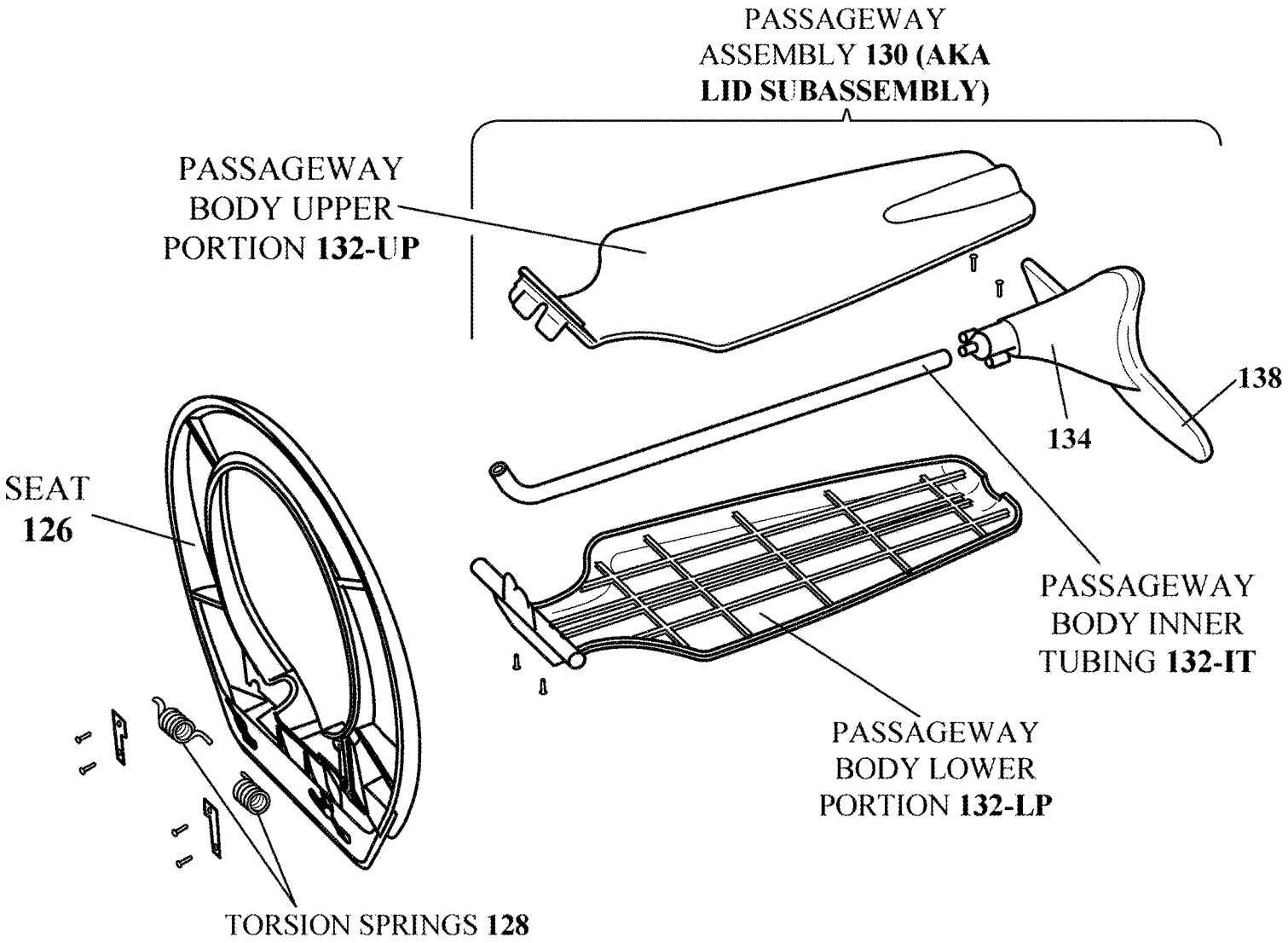
FIG. 13 is a top plan view of that shown in FIG. 9. The passageway assembly 130 is shown disassembled, showing separate components passageway body upper portion 132-UP, passageway body upper portion 132-LP, passageway body inner tubing 132-IT, and the subassembly component including the inlet funnel 134 and handles 138.

FIG. 13 is a top plan view of that shown in FIG. 9. The passageway assembly 130 is shown disassembled, showing separate components passageway body upper portion 132-UP, passageway body upper portion 132-LP, passageway body inner tubing 132-IT, and the subassembly component including the inlet funnel 134 and handles 138.

Figure 14:
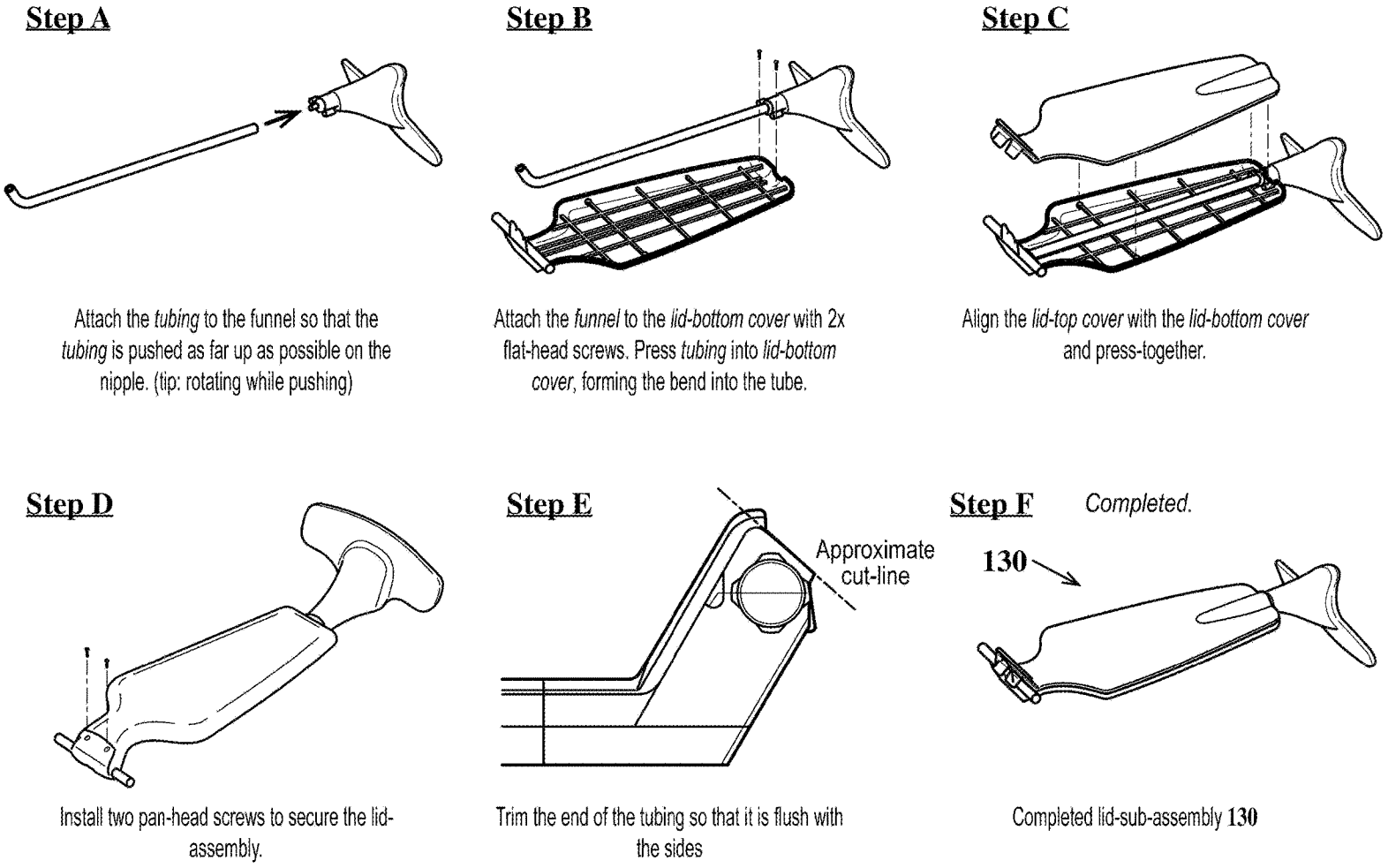
FIG. 14 shows the assembly of lid subassembly 130 (aka passageway assembly 130).

FIG. 14 shows the assembly of lid subassembly 130 (aka passageway assembly 130).

FIG. 15 shows Part One of the assembly of lid subassembly 130 (aka passageway assembly 130) to seat 126.

Figure 16:
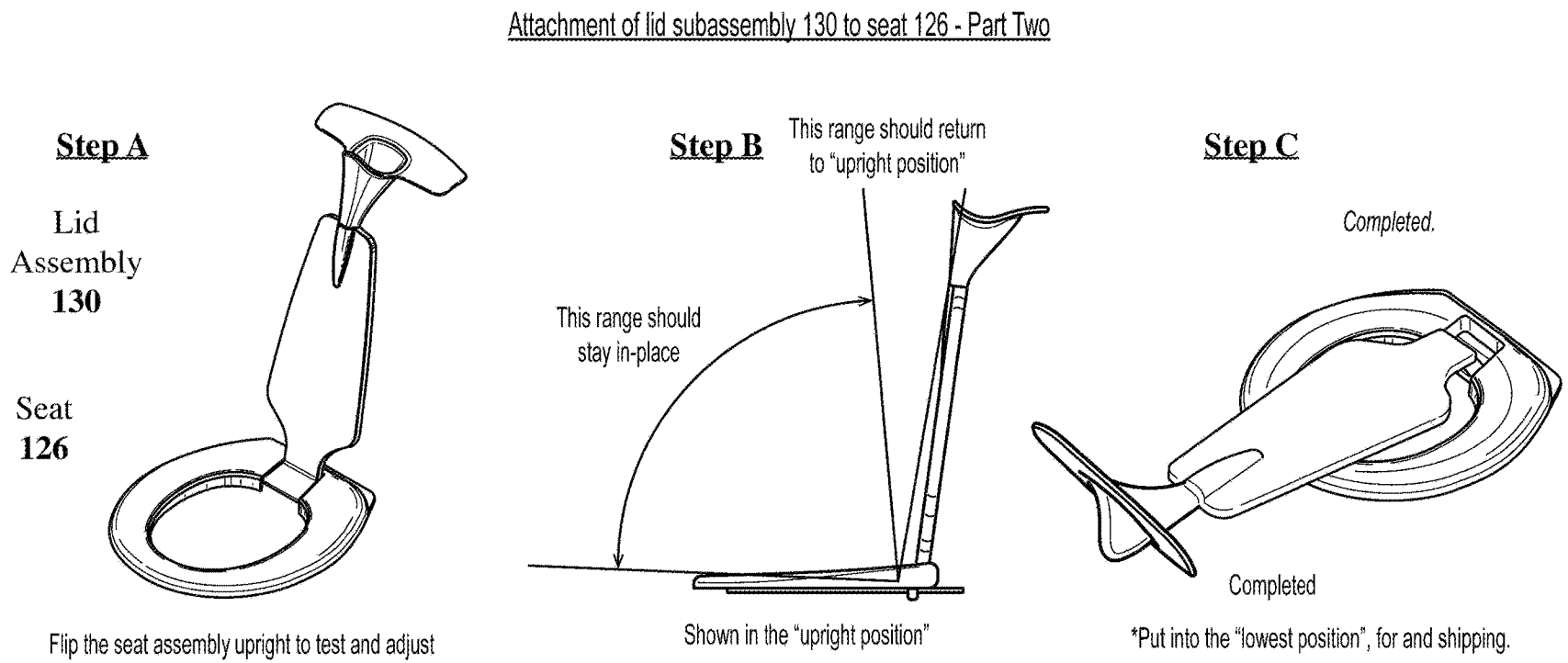
FIG. 16 shows Part Two of the assembly of lid subassembly 130 (aka passageway assembly 130) to seat 126.

FIG. 16 shows Part Two of the assembly of lid subassembly 130 (aka passageway assembly 130) to seat 126.

Referencing now to FIG. 14, assembly of the lid subassembly 130 is as follows. As shown in Step A, the tubing is attached to the funnel so that the tubing is pushed as far up as possible on the nipple. Rotation while pushing could be helpful here. In Step B, the funnel may be attached to the lid-bottom cover with two flat head screws. Tubing is placed into the lid bottom cover, forming the bend into the tube. In Step C, the lid-top cover is aligned with the lid bottom cover, and they are pressed together. In Step D, two pan head screws are installed to secure the lid assembly. In Step E, the end of the tubing may be trimmed so that it is flush with the sides. In the last step in this figure, the completed lid subassembly is shown. This subassembly is listed as 130 in FIG. 9.

Referencing now to FIG. 15, Part One of attachment of the lid assembly 130 to seat 126 is now discussed. As shown in Step A, left and right springs (labeled 128 in FIG. 12) are slid onto the axle of the lid subassembly 130. In Step B, grease is applied to the bearing surfaces in the seat. In Step C, the lid assembly is placed into the seat. The springs are aligned in the seat. As shown in Step D, it should be ensured that the springs are within their alignment ribs before proceeding to the next step. In Step E, grease should be applied to the top of the axle and both lid retaining brackets installed with one pan head screw each. In Step F, a pan head screw should be installed in the remaining holes on the lid retaining brackets so that the screw begins to compress the bracket. The screws should not be fully tightened.

Referencing now to FIG. 16, Part Two of attachment of the lid assembly 130 to seat 126 is now discussed. As shown in Step A, the seat assembly should be flipped upright to test and adjust hinge behavior. The lid should be moved through the full range of movement three times before making adjustments. Note that tightening the screws at the back of the lid retaining brackets will increase the hinge friction. Both sides should be adjusted with half turns of the screws until the intended hinge behavior is achieved. Step B shows the desired range of motion and behavior, in both the upright and lowest position. Step C shows the completed item ready for shipping.

Installation and Operation of the configuration shown in FIGS. 9-16 is as follows.

The configuration shown in FIG. 9 is installed on a conventional toilet having a stationary bowl 124 (shown in FIG. 9) in a manner as shown with reference now also to FIGS. 11 and 12. It should be understood that the seat attachment fasteners 129 attach the seat 126 to a conventional toilet much in the same way a conventional toilet seat/lid combination is attached to a toilet; two fasteners are used to attach the seat (and lid if appropriate) proximate the rear of a toilet bowl, such that the toiled bowl and/or lid may pivot as desired relative to the typically stationary toilet bowl.

Once the seat 126 is attached as shown in FIG. 9 to the bowl 124, the configuration is free to pivot as shown in FIG. 16, Step B. As shown in that figure, there is a range where the lid assembly should stay in place, if released at that point by the user. There is also another range more towards the upright position in which the lid should return to the extreme upright position by pivoting about the Pivot Axis PA (of FIG. 9).

Normal operation of the configuration shown in FIGS. 9-16 is similar to that of the configuration shown in FIG. 1. The passageway assembly 130 is pivotably attached relative to the seat 126 (as well as the toilet bowl) about the Pivot Axis PA, which includes a passageway body 132, an inlet funnel 134, an exit port 136 of the passageway, and handles 138. Also shown is a Pivot Axis PA, and a seat 126.

The passageway assembly 130 is used for the disposal of urine, with the passageway assembly 130 having an inlet funnel 134 configured to accept urine from the user, such that said urine may be diverted to a remote location. The inlet funnel 134 may be manipulated from its "stored/retracted" position, as shown in FIG. 9, to an "engaged/extended" position in which the inlet funnel 134 is more in the path of conventional urination, such that urine may be captured in the inlet funnel 134, then travel within the passageway body through the passageway body inner tubing 132-IT (See FIG. 13) down and out of the exit port 136, such that urine is dispensed into the back of the bowl of the toilet. It may be understood that the urine technically passes along this path through the opening in the seat 126, but it could also go through or behind the seat.

A foot pedal is not shown with this configuration, but could be used.

Sensors

Presence and/or motion sensors could also be used in conjunction with the devices herein.

For example, a sensor could be positioned on the left or right side of the tank or funnel of a toilet, with activation of the sensor by an intentional movement, such as the waving of a hand, being used to move the passageway assembly in or out of a certain position. For example, a hand operated sensor (which would not be activated if someone wished only to sit on the seat) could be used to move the passageway assembly in or out of its extended position.

Sensors could also be used in order to facilitate flushing of the toilet when it is determined that a person is no longer in the detection zone.

The sensor could also sense motion directly above funnel or slightly forward of it (but not forward enough to engage when a person is seated).

The sensor on the toilet could sense movement of the member when it is moved back to the retracted position, or for any other movement of the device to a desired position.

Variations

Figure 17:
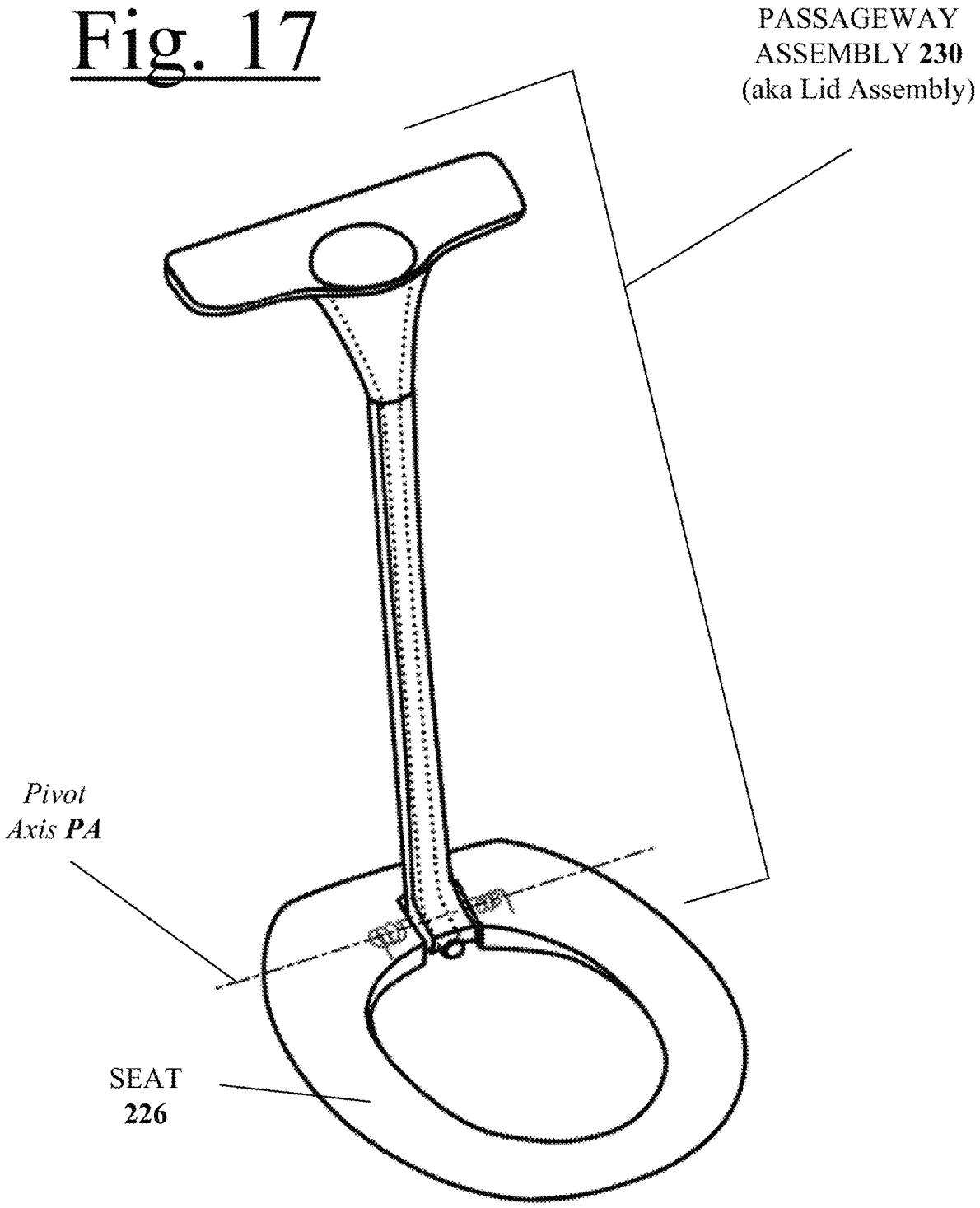
FIGS. 17 and 18 shows another simplified views of a lid assembly 230 and a seat 226. Both of these elements are pivotably attached relative to the toilet bowl in a manner similar to that described above. It should be understood that a conventional toilet with the bowl as shown could be retrofitted with the device of the present invention, by replacing a conventional toilet seat/lid combination with a modified toilet seat/lid combination with the inlet funnel in the lid or the seat. Such a conventional configuration would include a toilet bowl including two holes proximate the rear of the bowl, said holes having coparallel bore axes which are substantially vertical when said toilet is conventionally installed.
Figure 18:
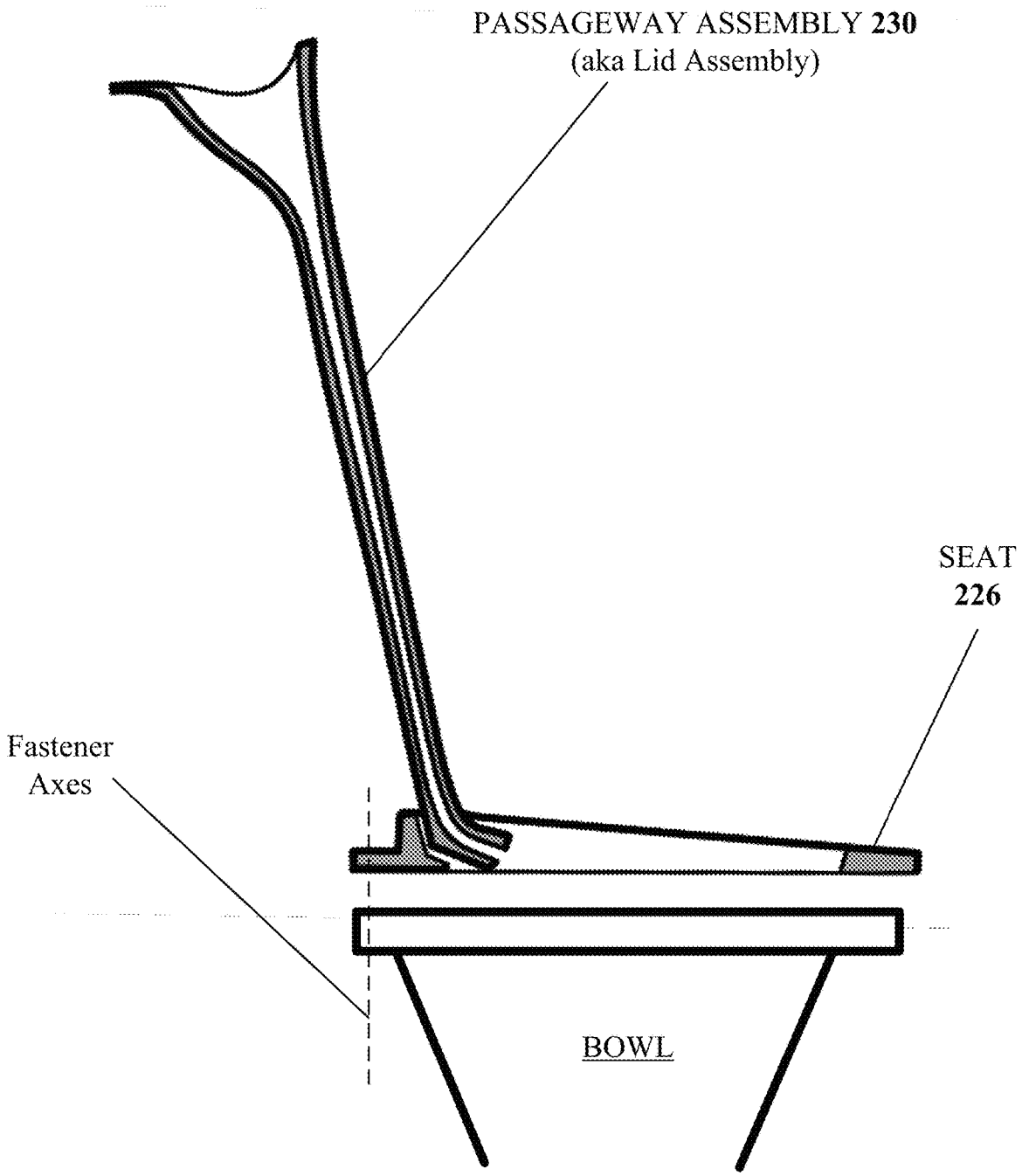

FIGS. 17 and 18 shows another simplified views of a lid assembly 230 and a seat 226. Both of these elements are pivotably attached relative to the toilet bowl in a manner similar to that described above. It should be understood that a conventional toilet with the bowl as shown in FIG. 18 could be retrofitted with the device of the present invention, by replacing a conventional toilet seat/lid combination with a modified toilet seat/lid combination with the inlet funnel in the lid or the seat. Such a conventional configuration would include a toilet bowl including two holes proximate the rear of the bowl, said holes having coparallel bore axes (see the dotted line in FIG. 18) which are substantially vertical when said toilet is conventionally installed.

Many variations may be made from the one or more versions shown above in which urine passes from a funnel at the end of the lid, then through the lid, and then exits into the bowl.

For example, instead of the passageway passing through the body of the lid, the passageway could be a tube attached to the top, side, or underside of the lid. The passageway could also be defined between suitably sealed two major plastic parts comprising the body of the lid—so the passageway would be part of the plastic, and not a separate tube.

Another alternative is the use of a single piece of injected plastic that has a passageway that travels all the way through the solid piece of plastic. This single piece of plastic would define the funnel, and serve the same function as the back and front of the lid all one piece. The hole would be injected into the plastic all the way through it, thus eliminating the need for an additional funnel tube.

As another example, instead of the passageway passing from a funnel attached to the lid through the body of the lid, the passageway could pass through a funnel attached to the seat through the body of the seat. In this case the funnel would be positioned generally between the legs while a person was in the sitting position, although it could be tucked away between the seat and rim.

Furthermore, it is possible for a "back" or third attachment to the assembly to take place of the lid. In this case, a member separate from the seat and lid could be dedicated to supporting the funnel and passageway. This third element would also pivot about axis PA and could be manipulated by handles and/or a foot pedal as noted elsewhere. It could pivot down from a retracted up position, or pivot up from a retracted down position. Under one configuration, the foot petal allows individuals to push with their foot allowing the back plate to be brought forward to the individual. Upon releasing the foot pedal, the spring would bring the back plate to its original position.

Advantages

The return feature, which causes the lid to be automatically moved to the up position, and the seat in the down position after use by the user, provides a high degree of convenience for the next user. When this feature is used with the above retraction/extension position, it solves the issue of a woman wanting the toilet seat down with very little effort to the man because it automatically returns everything to the seated position for a woman simply by the man releasing the handles or foot pedal.

The foot pedal allows for the individual to avoid touching the toilet seat assembly and solves a sanitary issue of touching unwanted surfaces.

The retraction/extension feature solves the issue of urine splatter in and around the toilet bowl and floor. The collection point of the toilet assembly will meet almost to the point where urine is released from the individual. The objective to this is to have a pathway for urine to travel so it will not be overly conspicuous and will effectively deliver urine to the toilet bowl. This will be done by concealing the pathway for urine to travel within the toilet seat assembly. As noted above, the spring located on the rod of the assembly solves the issue of where a toilet seat should (or should not be) left by automatically returning the toilet seat assembly to a position prepared for a seated position, with the lid up and the seat down.

These are only a few of the many advantages.

CONCLUSION

Various modifications and variations can be made in the present invention without departing from the spirit or scope of the invention.

From the foregoing, it will be seen that this invention is one well adapted to obtain all the ends and objects herein set forth, together with other advantages which are obvious and which are inherent to the structure.

It will be understood that certain features and sub combinations are of utility and may be employed without reference to other features and sub combinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention claimed is:

1. A device for use with a toilet, said toilet including a toilet bowl having a front and rear, said bowl configured to accept solid and urine waste from a human while sitting upon a human sitting surface defined above said bowl, said bowl configured to accept urine from a urine stream passing along a urine path into said bowl, said urine stream originating from said human while standing at a standing position at the front of the bowl and facing the bowl, said device comprising:

A) a seat member defining a seat member sitting surface portion, said seat member sitting surface portion defining at least a part of said human sitting surface defined above said bowl, said seat member configured for allowing said human to sit at a sitting position such that solid waste configured to be transferred into said bowl while said human is sitting on said seat member, said seat member having a rear outer peripheral edge portion positioned on the opposite side of said bowl relative to said standing position of said human such that said bowl is between said rear outer peripheral edge portion and said standing position of said human, said rear outer peripheral edge portion directed away from said standing position of said human such that it is the portion of said seat member which is furthest away from said standing position of said human;

B) a movable lid assembly pivotably movable about a lid pivoting axis from a first, up position to a second, urine receiving position, said pivotably movable lid assembly including:

1) a urine receptacle having an inlet and an outlet;

2) a passageway body connected to said urine receptacle and defining a passageway from said urine receptacle inlet to a passageway body outlet, and including a lower pivoting connection portion containing a lower portion of said passageway, said lower providing connection portion providing a pivoting connection between said movable lid assembly and said seat member about said lid pivoting axis, said lower portion of said passageway passing in front of said lid pivoting axis, said movable lid assembly being configured to be moved from said first, up position wherein said inlet is spaced apart from said urine stream, to said second, urine receiving position wherein said inlet intercepts at least a portion of said urine stream above said toilet bowl, and said receptacle diverts said portion of said urine stream through said passageway, including through said lower portion of said passageway while remaining in front of the lid pivoting axis, and finally into said toilet bowl.

2. The device as claimed above in claim 1, wherein said seat member also defines a notch configured to accept a portion of said pivoting connection portion of said movable lid assembly, such that said lower providing connection portion of said passageway body is capable of pivoting within said notch about said lid pivoting axis from said first, up position to said second, urine receiving position.

* * * * *